US008646868B2

(12) United States Patent
Tomita et al.

(10) Patent No.: US 8,646,868 B2
(45) Date of Patent: Feb. 11, 2014

(54) INKJET RECORDING APPARATUS AND DENSITY ADJUSTMENT METHOD THEREOF

(75) Inventors: Hiroki Tomita, Ibaraki-ken (JP); Yoshiyuki Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 86 days.

(21) Appl. No.: 13/306,519

(22) Filed: Nov. 29, 2011

(65) Prior Publication Data

US 2012/0133696 A1 May 31, 2012

(30) Foreign Application Priority Data

Nov. 30, 2010 (JP) ..... P2010-266600

(51) Int. Cl.
*B41J 29/38* (2006.01)

(52) U.S. Cl.
USPC ..... 347/19

(58) Field of Classification Search
USPC ..... 347/5–20, 40–43, 75, 81, 101, 107
IPC ..... B41J 29/38
See application file for complete search history.

(56) References Cited

U.S. PATENT DOCUMENTS

| | | | | |
|---|---|---|---|---|
| 6,322,186 | B1 * | 11/2001 | Shimizu et al. | 347/15 |
| 2002/0012018 | A1 * | 1/2002 | Ohtsuka et al. | 347/19 |
| 2006/0050101 | A1 * | 3/2006 | Sakaida | 347/19 |
| 2006/0214960 | A1 * | 9/2006 | Chiwata | 347/10 |
| 2009/0231376 | A1 * | 9/2009 | Moriya | 347/14 |
| 2010/0039469 | A1 * | 2/2010 | Shimosato et al. | 347/14 |

FOREIGN PATENT DOCUMENTS

JP 2006-137040 A 6/2006

* cited by examiner

*Primary Examiner* — Manish S Shah
*Assistant Examiner* — Roger W Pisha, II
(74) *Attorney, Agent, or Firm* — Nath, Goldberg & Meyer; Jerald L. Meyer

(57) ABSTRACT

An adjustment drop number setting section 335 sets a number of adjustment drops with which a change in print density in an image occurs remarkably when an ink drop amount of one ink drop is changed for each kind of a print medium (print sheet) input from an operation panel 340 or sets uniformly regardless of the kind of print medium. When a density difference that requires adjustment is recognized visually between images by two neighboring ink heads on a density measurement chart printed by a chart printing execution section 333*c*, the ink drop amount of one drop in the set number of adjustment drops is adjusted by adjusting a drive voltage of the ink head of a head unit 110 according to an input from the operation panel 340.

8 Claims, 9 Drawing Sheets

INKJET RECORDING APPARATUS AND DENSITY ADJUSTMENT METHOD THEREOF

BACKGROUND OF THE INVENTION

1. Technical Field

The present invention relates to an inkjet recording apparatus that forms an image on a print medium by discharging ink from a plurality of ink heads and, more particularly, to a density adjustment module and a density adjustment method for adjusting the density in an image that is formed.

2. Background Arts

Conventionally, an inkjet type recording apparatus that forms an image by discharging ink from an inkjet recording head onto a print sheet is widely used. This type of recording apparatus includes a line inkjet recording apparatus in which ink heads are directly-aligned and recording is performed only by a sub scan, in which a print sheet is sent in the transfer direction. In a line inkjet recording apparatus, recording corresponding to one line at one time is performed successively to a print sheet.

An ink head of an inkjet recording apparatus includes a pressure chamber having a nozzle and in this recording apparatus, ink is discharged by pressurizing ink within the pressure chamber. However, the above-described line inkjet recording apparatus has such a problem that there occurs a density difference of ink discharged from each ink head because the discharge efficiency of ink differs from head to head even if the same voltage is applied, and therefore, an image having a tone jump is printed.

In order to solve such a problem, according to the technique disclosed in Patent Document (Japanese Patent Application Laid-Open No. 2006-137040), the density difference between heads is reduced by adjusting the voltage difference between ink heads based on the density characteristics within the head.

SUMMARY OF THE INVENTION

However, the technique disclosed in the above-mentioned Patent Document has not at all taken the kind of print sheet into consideration, and therefore, there is a possibility that the density difference may not be corrected sufficiently only by adjusting the density difference between heads That is, on some print sheet, such as plain paper, ink tends to blot and a mesh point becomes large, that is, the so-called dot gain tends to occur, and therefore, for such a print sheet, it is necessary to make adjustment with the characteristics of the print sheet taken into consideration.

Further, in recent years, a recording apparatus including an inkjet head of multi-drop type has been proposed. In the inkjet recording apparatus of multi-drop type, an image is formed by successively discharging a plurality of ink drops to the same pixel from one nozzle and by subjecting the density of the pixel to gradation change according to the number of ink drops discharged. In such an inkjet recording apparatus of multi-drop type, the change in the number of ink drops discharged from each head and the change in print density in an image are not necessarily in a linear proportional relationship depending on the print sheet.

Because of the above, it is ideal to change the voltage for each number of ink drops when adjusting the density difference between heads using the technique disclosed in the above-mentioned Patent Document. However, such a configuration is impractical in terms of cost.

The present invention has been made in order to solve the above-mentioned problem and an object thereof is to provide an inkjet recording apparatus and a density adjustment method thereof, which are capable of efficiently and appropriately making density adjustment to reduce a density difference between heads in an inkjet recording apparatus in which ink heads with the variable drop amount of ink to be discharged are directly-aligned.

In order to achieve the above-mentioned object, as an inkjet recording apparatus according to an embodiment of the present invention, there is provided an inkjet recording apparatus including at least one head unit having a plurality of ink heads and forming an image on a print medium by discharging a plurality of ink drops from each ink head, comprising: an ink head specifier configured to specify an ink head, which is a target of adjustment of print density in the image, in a density adjustment mode of adjusting the print density in the image; an adjustment contents specifier configured to specify contents of adjustment of an ink drop amount in the number of adjustment drops with which an amount of change in the print density in the image for a change in ink drop amount is not less than a predetermined value as to the ink head specified by the ink head specifier in the density adjustment mode; and a drop amount adjuster configured to adjust the ink drop amount of one ink drop in the number of adjustment drops of the ink head specified by the ink head specifier with the contents of adjustment specified by the adjustment contents specifier.

Further, in order to achieve the above-mentioned object, in an inkjet recording apparatus according to an embodiment of the present invention, as a method for adjusting the density in the image, there is provided a method for adjusting print density in an image in an inkjet recording apparatus provided with at least one head unit having a plurality of ink heads and forming the image on a print medium by discharging a plurality of ink drops from each ink head, the method comprising: specifying the ink head, which is a target of adjustment of print density in the image, in a density adjustment mode of adjusting print density in the image; specifying contents of adjustment of an ink drop amount of one ink drop in a number of adjustment drops with which an amount of change in print density in the image for a change in ink drop amount is not less than a predetermined value as to the specified ink head in the density adjustment mode; and adjusting an ink drop amount of one ink drop in the number of adjustment drops of the specified ink head with the specified contents of adjustment.

BRIEF DESCRIPTION OF THE DRAWINGS

FIGS. 2A and 2B are explanatory diagrams of a head holder in FIG. 1, wherein FIG. 2A is an explanatory diagram showing the head holder in FIG. 1 from below and FIG. 2B is an explanatory diagram showing an enlarged side sectional view of the head holder.

FIGS. 7A to 7C show a change in state due to a change in the number of ink drops discharged to plain paper, wherein FIG. 7A is a graph showing a relationship between the number of drops and the print density in an image and FIGS. 7B and 7C are explanatory diagrams showing a difference in the state where ink spreads on paper for the number of drops.

FIGS. 8A and 8B are graphs showing a density difference between heads according to the number of ink drops in the inkjet recording apparatus in FIG. 1, wherein FIG. 8A shows a case of plain paper and FIG. 8B a case of mat paper, respectively.

FIGS. 9A to 9C show a change in state due to a change in the number of ink drops discharged to mat paper, wherein FIG. 9A is a graph showing a relationship between the number of drops and the density in an image and FIGS. 9B and 9C are explanatory diagrams showing a difference in the state where ink spreads on paper for the number of drops.

DESCRIPTION OF THE EMBODIMENTS

General Configuration of Inkjet Recording Apparatus

Figure 1:
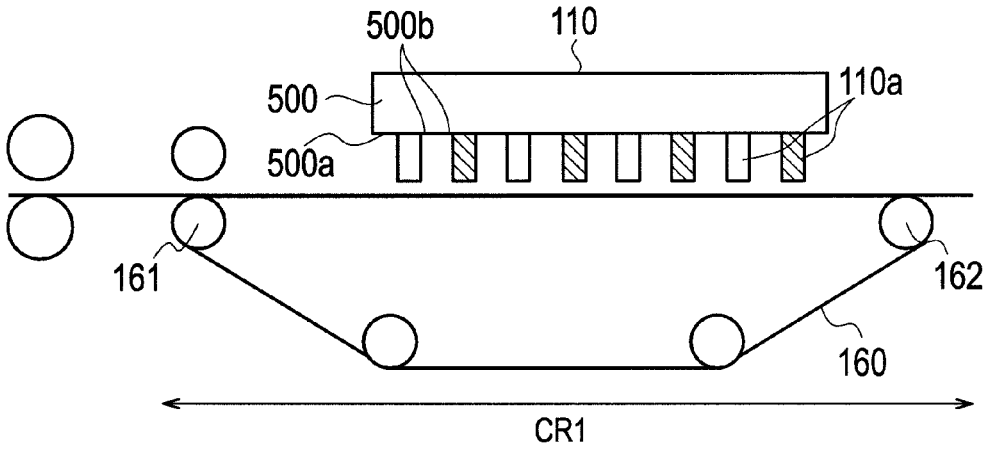
FIG. 1 is an explanatory diagram showing, from the lateral side, an image formation section in an inkjet recording apparatus according to an embodiment of the present invention.
Figure 2A:
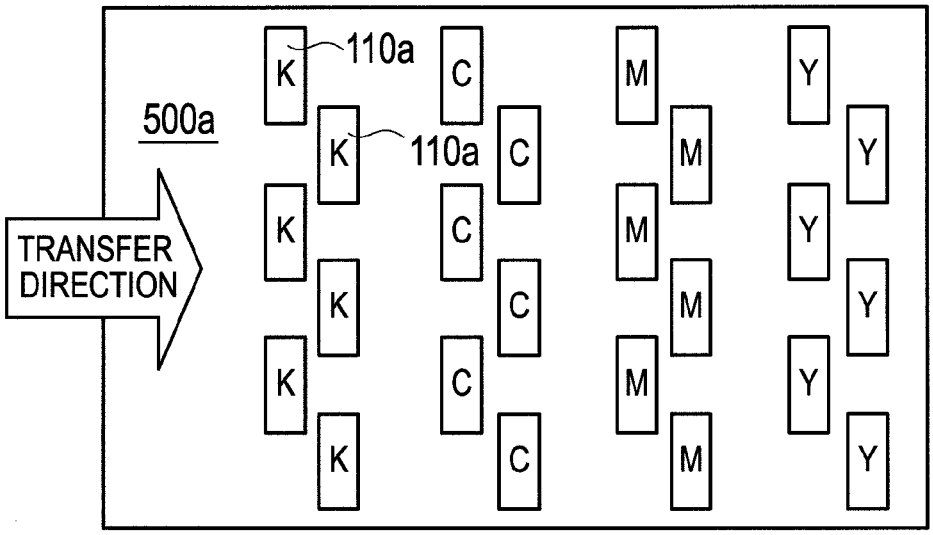
Figure 2B:
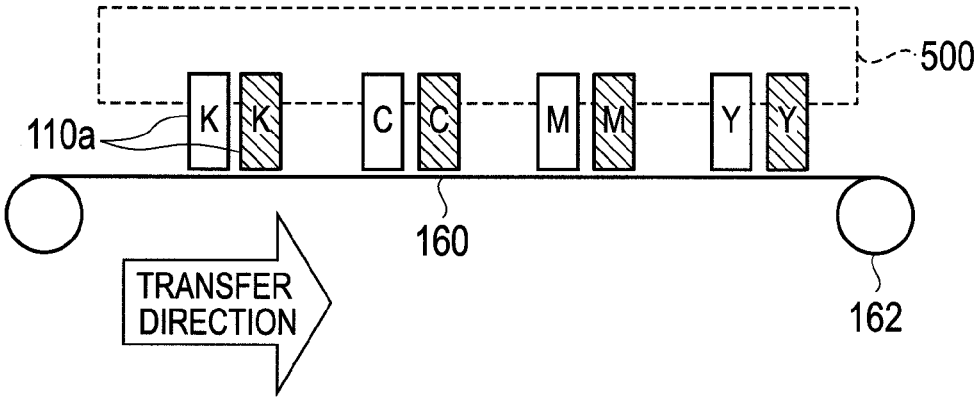

Hereinafter, embodiments of the present invention are explained with reference to the drawings. FIG. 1 is an explanatory diagram showing, from the lateral side, an image formation path CR1 in which an image is formed in an inkjet recording apparatus according to the present embodiment. FIGS. 2A and 2B are explanatory diagrams of a head holder in FIG. 1, wherein FIG. 2A is an explanatory diagram showing a head holder 500 in FIG. 1 from below, which is disposed above the image formation path CR1, and FIG. 2B is an explanatory diagram showing an enlarged side sectional view of the head holder 500.

It is assumed that the inkjet recording apparatus according to the present embodiment is an inkjet type line color printer having a head unit 110, which is an image formation section, and performing printing in units of line by discharging black or color ink from a nozzle of an ink head 110*a* provided in the head unit 110. Further, the inkjet recording apparatus according to the present embodiment has the ink head 110*a* of multi-drop type, in which a plurality of ink drops is discharged successively to the same pixel from one nozzle. In the inkjet recording apparatus having the ink head 110*a* of multi-drop type, it is possible to subject the density of the pixel to gradation change according to the number of ink drops (drop amount) discharged to the same pixel from one nozzle.

As shown in FIG. 1, the inkjet recording apparatus according to the present embodiment includes the image formation path CR1 as a transfer path and in the image formation path CR1, a print medium 10 (print sheet: see FIG. 3) is transferred at a speed determined by the printing condition by a platen belt 160. Above the image formation path CR1, the head unit 110 is arranged in opposition to the platen belt 160 and from a nozzle of each ink head 110*a* provided in the head unit 110, ink of each color is discharged in units of line onto the print medium 10 on the platen belt 160 and a plurality of images is formed so that they overlap one another.

To state in detail, the image formation path CR1 includes the platen belt 160, which is an endless transfer belt, a drive roller 161, which is a drive mechanism of the platen belt, a driven roller 162, etc. Above the image formation path CR1, the head holder 500 is provided and the ink head 110*a* is held.

The platen belt 160 is moved circularly by the drive roller 161 and transfers the print medium 10 by sliding the print medium 10 in a range in opposition to the ink head 110*a*. Specifically, the platen belt 160 is hooked between a pair of the drive roller 161 and the driven roller 162 arranged perpendicular to the transfer direction and by the drive force of the drive roller 161, is circled in the transfer direction.

The head holder 500 is a box-shaped body having a head holder surface 500*a* as a bottom surface and holds and fixes the ink head 110*a* and at the same time, unites and accommodates other functional sections configured to discharge ink from the ink head 110*a*. Further, the head holder surface 500*a*, which is the bottom surface of the head holder 500, is arranged in opposition to the transfer path so as to be parallel with it. In the head holder surface 500*a*, a plurality of attachment openings 500*b* is arranged. Each attachment opening 500*b* is formed into the same shape as that of the horizontal section of the ink head 110*a*. Each of the plurality of the ink heads 110*a* is inserted through each attachment opening 500*b* and its discharge outlet is caused to protrude from the head holder surface 500*a*.

As shown in FIGS. 2A and 2B, a plurality of the ink heads 110*a* is provided for each color, that is, K (black), C (cyan), M (magenta), and Y (yellow). The ink heads 110*a* of each color configure a line in a direction (main scan direction) perpendicular to the transfer direction (sub scan direction) of the print medium. The line of each color includes sub lines in two rows along the sub scan direction and the plurality of the ink heads 110*a* configuring each sub line and arranged at fixed intervals is arranged in positions shifted in the main scan direction for every two heads.

Figure 3:
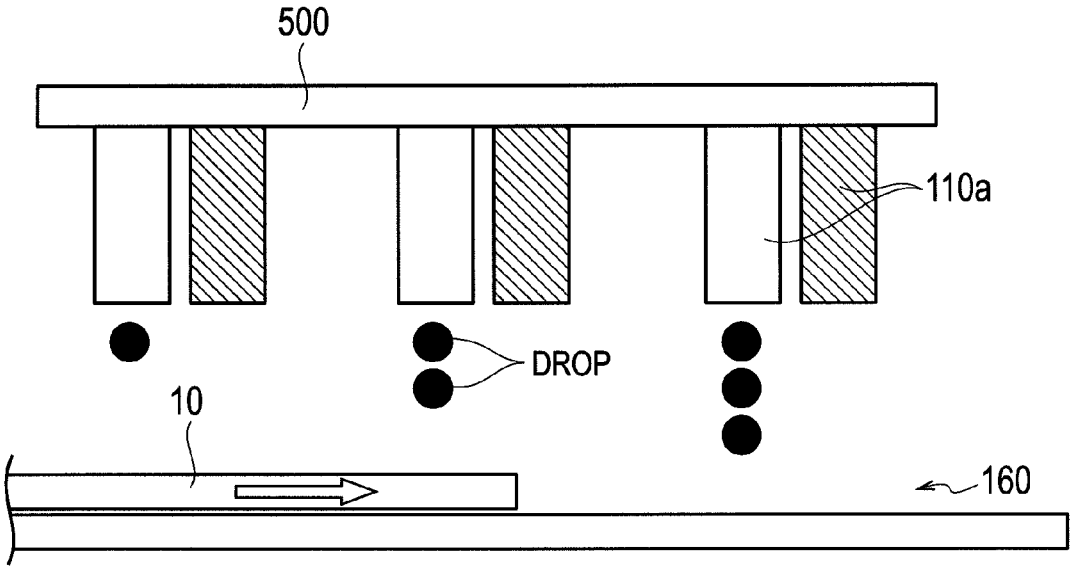
FIG. 3 is an explanatory diagram showing an ink discharge operation of an ink head in FIG. 1.

Further, in the inkjet recording apparatus according to the present embodiment, it is possible to change the number of ink drops to be discharged from each ink head 110*a* as shown in FIG. 3. That is, the density of a dot changes depending on the number of ink drops to be discharged. The inkjet recording apparatus according to the present embodiment includes a function to adjust the size of a drop by change in a drop amount. It is possible to adjust the drop amount in the ink head 110*a* by adjusting the drive voltage of the ink head 110*a*.

(Structure of Density Adjustment Module)

Figure 4:
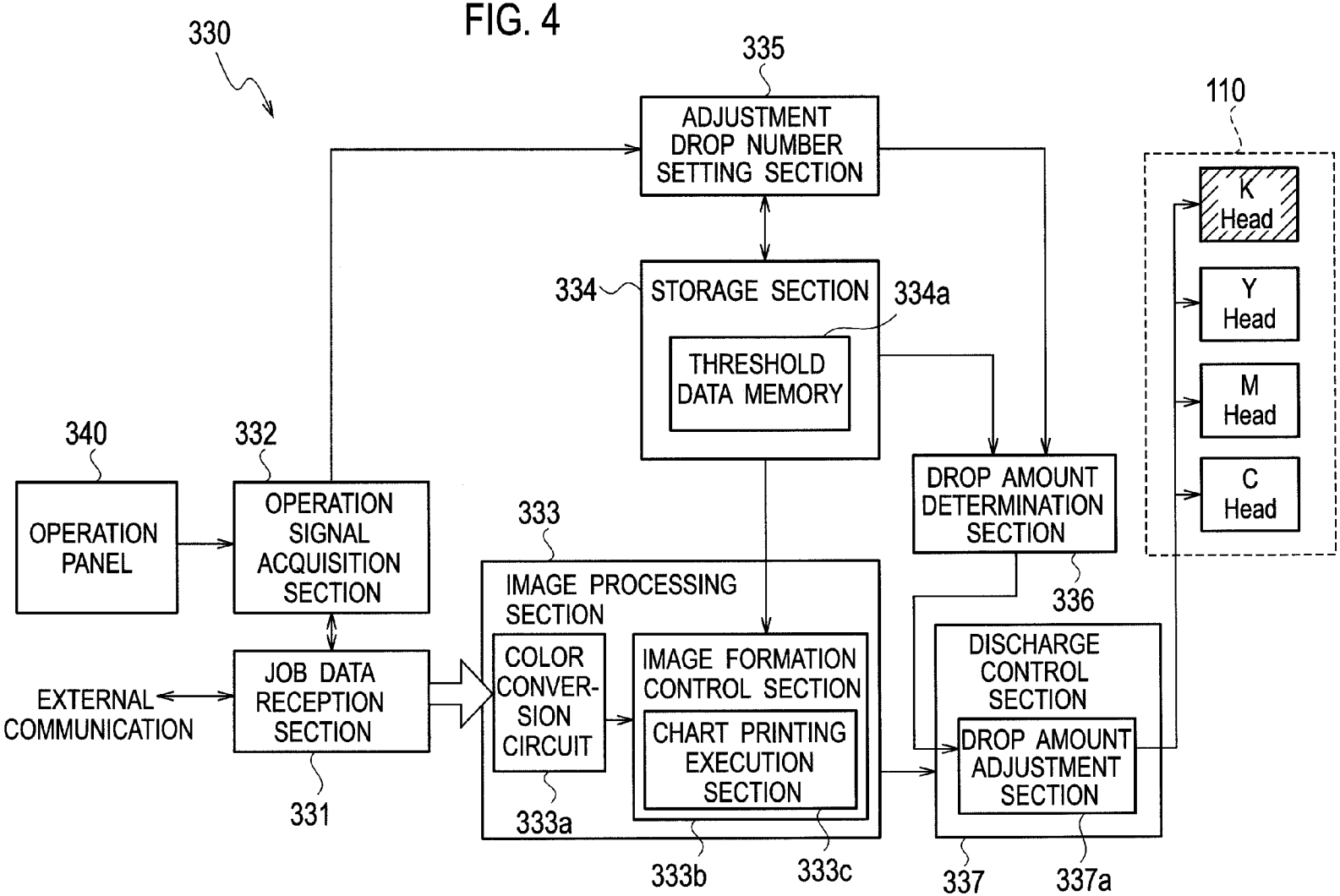
FIG. 4 is a block diagram showing a module relating to density adjustment control of an operation processing section of the inkjet recording apparatus in FIG. 1.

Density adjustment processing of an image in the present embodiment is performed by controlling the operation of the head unit 110 and each drive unit by an operation processing section 330 provided in the inkjet recording apparatus. FIG. 4 is a block diagram showing a module relating to the density adjustment of the operation processing section 330 according to the present embodiment. The term "module" used in the explanation refers to a functional unit to achieve a predetermined operation, which includes hardware, such as a device and equipment, software having the function, or a combination thereof.

As shown in FIG. 4, the operation processing section 330 includes a job data reception section 331, an operation signal acquisition section 332, an image processing section 333, a storage section 334, an adjustment drop number setting section 335, a drop amount determination section 336, and a discharge control section 337 as modules relating to density control.

The job data reception section 331 is a communication interface to receive job data, which is a series of units of printing processing, and a module to deliver print data included in the received job data to the image processing section 333. Here, the communication includes, for example, short-distance communication, such as infrared communication, in addition to an intranet (intra-company network) by 10BASE-T and 100BASE-TX, and LAN of a home network.

The operation signal acquisition section 332 is a module to receive an operation signal by a user from an operation panel 340 and analyze the received operation signal and cause another module to perform processing in accordance with the user operation. In particular, in the present embodiment, the operation signal acquisition section 332 receives an instruction operation and setting operation relating to density adjustment processing by a user from the operation panel 340 or a printer driver connected through external communication. The operation signal received by the operation signal acquisition section 332 is input to the adjustment drop number setting section 335 and the job data reception section 331 as a control signal.

The operation signal acquisition section 332 also includes a function to acquire the kind of the print medium relating to printing as data of sheet kind. In the present embodiment, the data of sheet kind is acquired from data input through the operation of the operation panel 340 and the data of sheet kind is sent out to the adjustment drop number setting section 335 in the density adjustment mode.

Figure 5:
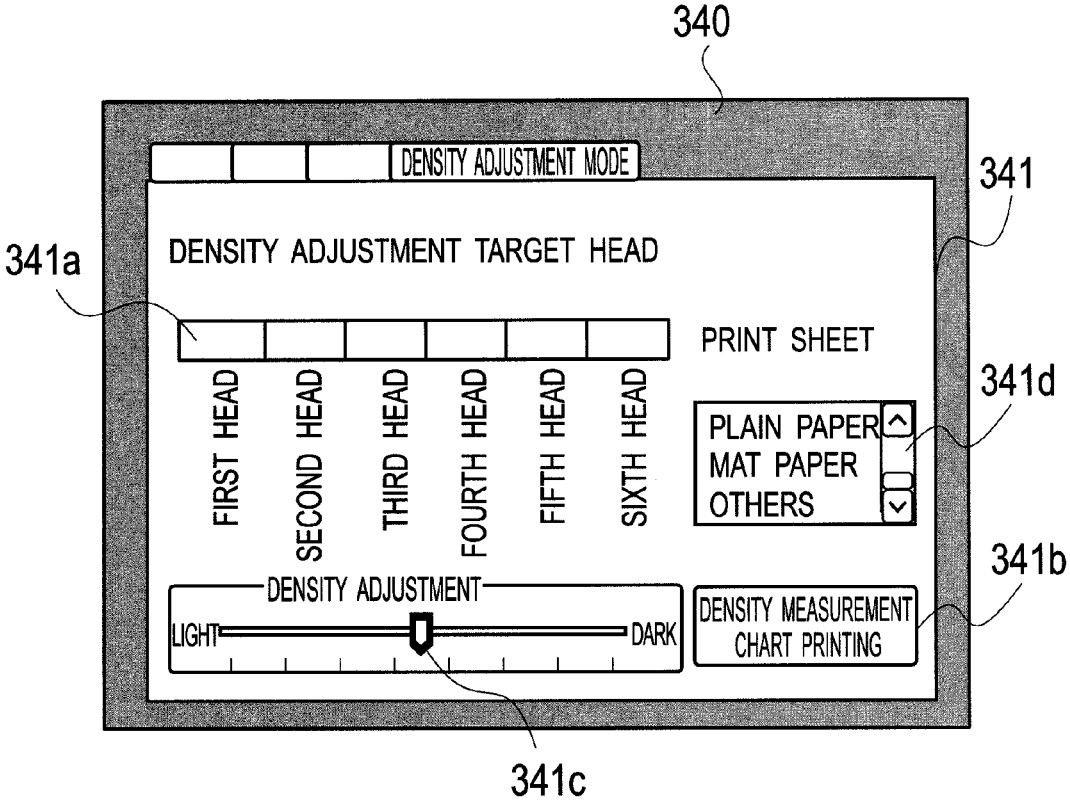
FIG. 5 is an explanatory diagram showing a screen configuration example of an operation panel in FIG. 4.

The operation panel 340 is a module to receive various instructions and setting operations and includes, for example, an operation screen 341 and a touch panel that covers the operation screen 341 as shown in FIG. 5 in the present embodiment. The operation screen 341 displays information about the density adjustment mode and produces a display to perform an operation relating to the density adjustment mode in cooperation with the touch panel.

On the operation screen 341, there are displayed an execution button 341*b* to print a density measurement chart (see FIG. 6), a selection area 341*a* to select the ink head 110*a* for which density adjustment is made, a slider 341*c* to input contents of density adjustment in the selected ink head, a list box 341*d* to input the kind of the print medium 10 (print sheet) to be used, and the like. When a user finds a part where the density difference between the ink heads 110*a* is remarkable while viewing the printed density measurement chart, it is possible to select the ink head 110*a* for which adjustment is made by touching the part of the head number (1 to 6) within the selection area 341*a* corresponding to the ink head 110*a* for which the density should be adjusted. It is possible to provide the operation screen 341 for each color and in that case, it is possible to instruct printing of the density measurement chart, select the ink head 110*a*, which is the target of density adjustment, and input contents of density adjustment for each color.

Figure 6:
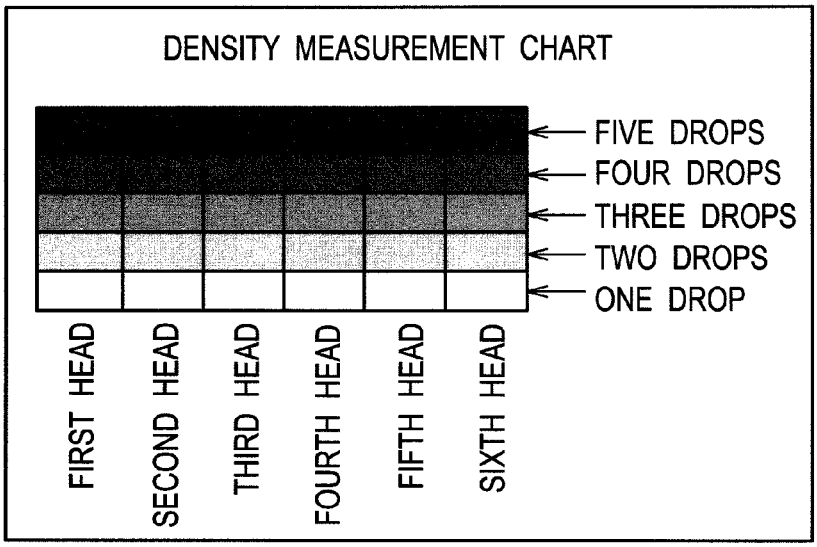
FIG. 6 is an explanatory diagram showing a density measurement chart used when performing a density adjustment method of the present invention.

Here, the density measurement chart printed in the density adjustment mode is a predetermined print pattern showing a correspondence relationship between the number of ink drops and the printing result (print density) in each ink head 110*a* as shown in FIG. 6 and printing can be performed for each color. In this density measurement chart, the density difference between each ink head 110*a* is represented by a gradational table in which the density difference is displayed visually in association with the number of ink drops by printing the predetermined print pattern under the same conditions by all the ink heads 110*a* while uniformly changing the number of ink drops.

In the present embodiment, the print pattern of the density measurement chart is a chart in which the density is changed stepwise by changing the number of ink drops, however, it may also be, for example, a print pattern of a solid image by a single ink drop amount set in advance as the number of ink drops suitable to determine whether or not density adjustment is necessary.

As shown in FIG. 4, the image processing section 333 is an operation processing device to perform digital signal processing specialized in image processing and a module to perform conversion of image data necessary for printing and perform printing. The image processing section 333 has an image formation control section 333*b* and a color conversion circuit 333*a*.

The color conversion circuit 333*a* is a circuit to convert an RGB print image into a CMYK print image and cause the image formation control section 333*b* to perform printing based on the print image of each color. The image formation control section 333*b* is a module to control the drive of the ink head of each color and the operation of the drive unit of the transfer path and control the entire image formation processing. Further, the image formation control section 333*b* includes a chart printing execution section 333*c*.

The chart printing execution section 333*c* is a module to automatically print a density measurement chart (see FIG. 6) in the density adjustment mode. Specifically, when the density adjustment mode is set and execution of printing of a density measurement chart is instructed, the chart printing execution section 333*c* reads a predetermined print pattern from the storage section 334 and printing processing is performed in such a manner that the number of ink drops (density) of each ink head 110*a* is changed stepwise.

Printing of a density measurement chart by the chart printing execution section 333*c* may be performed based on the user operation acquired by the operation signal acquisition section 332, or may be performed automatically at the time of maintenance, or performed periodically by a timer function.

The storage section 334 stores data in memory 334*a* of the number of ink drops (number of adjustment drops) discharged from the ink head 110 *a*, which is the target of density adjustment, associated with each kind of the print medium 10 (print sheet). Further, the storage section 334 is a module to transmit data about the number of ink drops (number of adjustment drops) discharged from the ink head 110*a*, which is the target of density adjustment, which data is input through the list box 341*d* of the operation screen 341 (see FIG. 5) and in accordance with the kind of the print medium 10 to be used in printing, to the drop amount determination section 336 and the image formation control section 333*b* at the time of printing processing.

Here, the stored contents of the storage section 334 are explained in detail. It is possible to input plain paper or mat paper as the kind of the print medium 10 to be used in printing through the list box 341*d* of the operation screen 341 (see FIG. 5).

When the print medium 10 is plain paper, ink tends to blot into paper and the dot gain is large, and therefore, there is a tendency for the amount of change in density (amount of change in dot size) to become smaller as the number of ink drops increases.

Figure 7A:
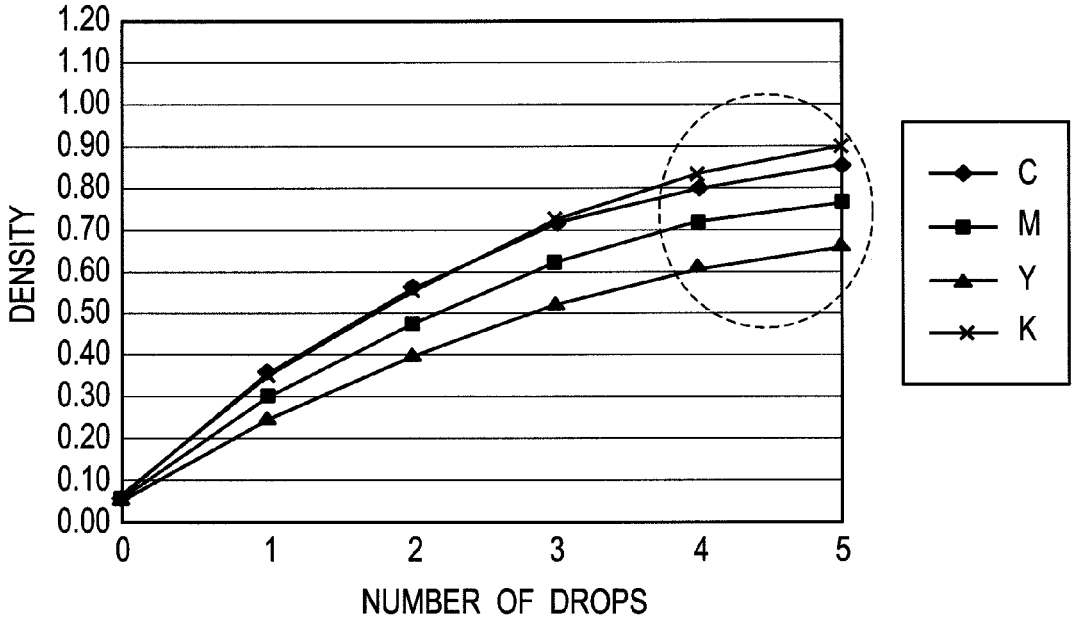
Figure 7B:
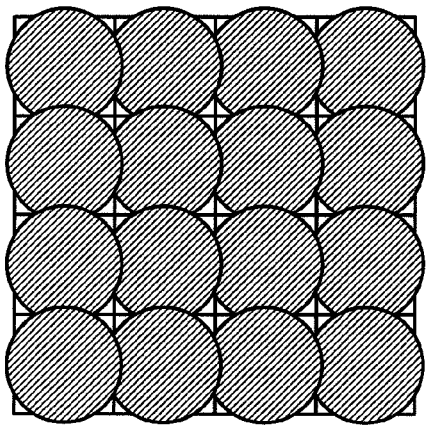
Figure 7C:
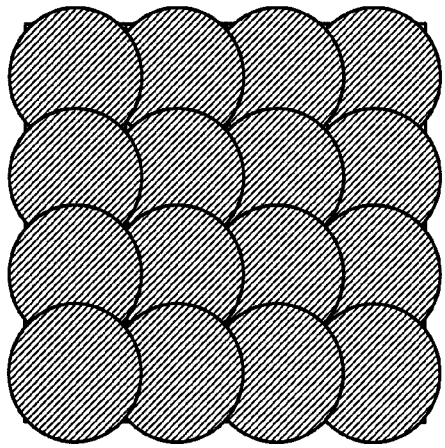

To state in detail, when the print medium 10 is plain paper, as the number of ink drops increases, blotting occurs in the print medium 10 and the dot gain becomes larger, and the change in dot gain per drop becomes small when the number of ink drops is four as shown in FIG. 7B and when the number of ink drops is five as shown in FIG. 7C. Consequently, as shown in FIG. 7A, when the number of ink drops is small, such as one to three drops, the print density changes linearly with the increasing number of ink drops, but when the number of drops is four or five, the change in print density with the increasing number of ink drops becomes small. As can be seen from FIG. 7A, this tendency can be seen basically independent of the ink color.

As described above, when the amount of change in density is small even if the number of ink drops is increased, it is not possible to fully expect the effect of a change in density even by adjusting the drive voltage of the ink head 110*a* with such a number of ink drops. This is obvious also from the following explanation.

Figure 8A:
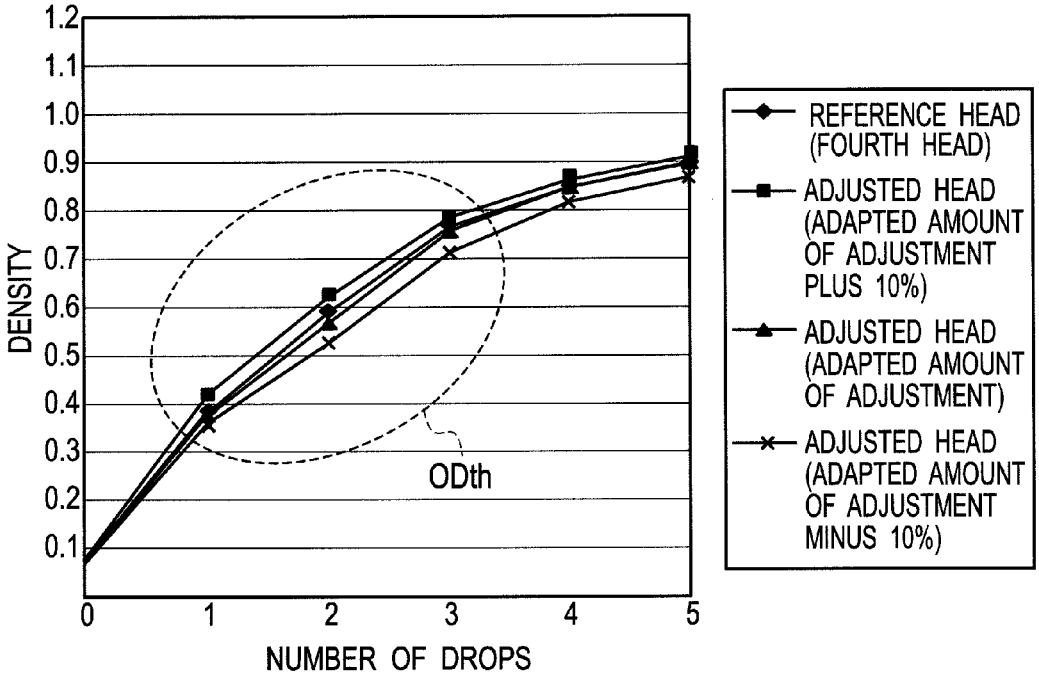

Detailed explanation is given with reference to FIG. 8A showing a case of plain paper. The line plotted by "◆" represents a relationship between the number and density of ink drops discharged from the ink head 110*a* (here, the fourth ink head), which is the reference of density adjustment. In contrast to this, the line plotted by "▲" represents a change in density of ink discharged from the ink head 110*a*, which is the target of density adjustment, and also represents the result of adjustment of the drive voltage of the ink head 110*a* in accordance with the density of ink discharged from the fourth ink head, which is the reference. On the assumption of the above, the line plotted by "■" represents a change in density when the drive voltage of the ink head 110*a* is changed by +10% and the line plotted by "x" represents a change in density when the drive voltage of the ink head 110*a* is changed by −10%.

From the comparison between the densities before and after the drive voltage of the ink head 110*a* is changed by ±10%, respectively, it is possible to see whether or not the density adjustment is effective. It can be seen that when the drive voltage of the ink head 110*a* is changed by ±10%, respectively, a change in density substantially in proportion thereto occurs when the number of ink drops is one to three. However, it can be seen that when the number of ink drops is four or five, a change in density does not occur so remarkably even if the drive voltage of the ink head 110*a* is changed by ±10%, respectively.

Because of the above, in the present embodiment, the number of adjustment drops for plain paper to be stored in the storage section 334 is taken to be three, which is the maximum number of one to three with which a change in density occurs correspondingly by the adjustment of the drive voltage of the ink head 110*a* (the number of ink drops at the time of one-time discharge of ink=3).

On the other hand, when the print medium 10 is mat paper, ink is hard to blot into paper and the dot gain is small, and therefore, even if the number of ink drops is four or five, the amount of change in density (the amount of change in dot size) does not change so much.

Figure 9A:
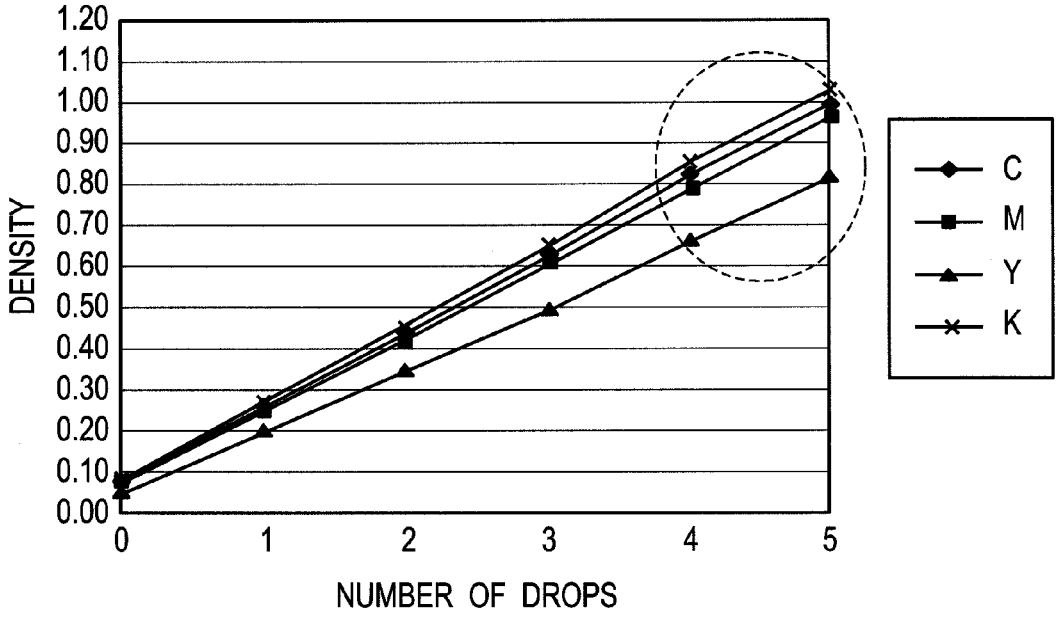
Figure 9B:
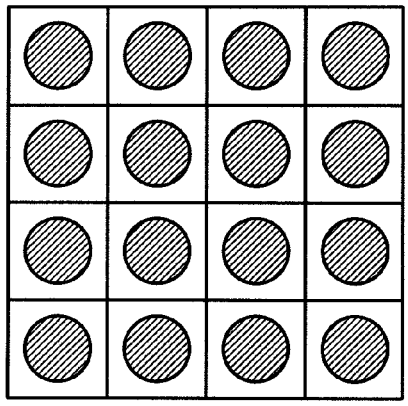
Figure 9C:
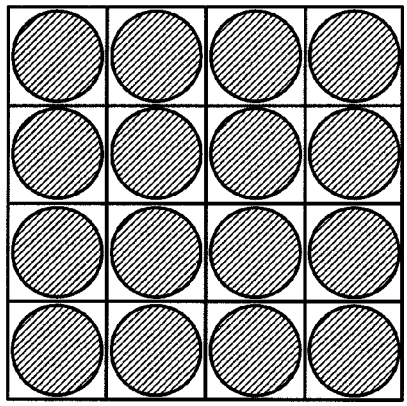

To state in detail, when the print medium 10 is mat paper, even when the number of ink drops changes from four to five, the area of the ink application region in units of drop increases according to the number of ink drops as shown in FIGS. 9B and 9C. Consequently, as shown in FIG. 9A, the print density changes (increases) linearly with the increasing number of ink drops.

Figure 8B:
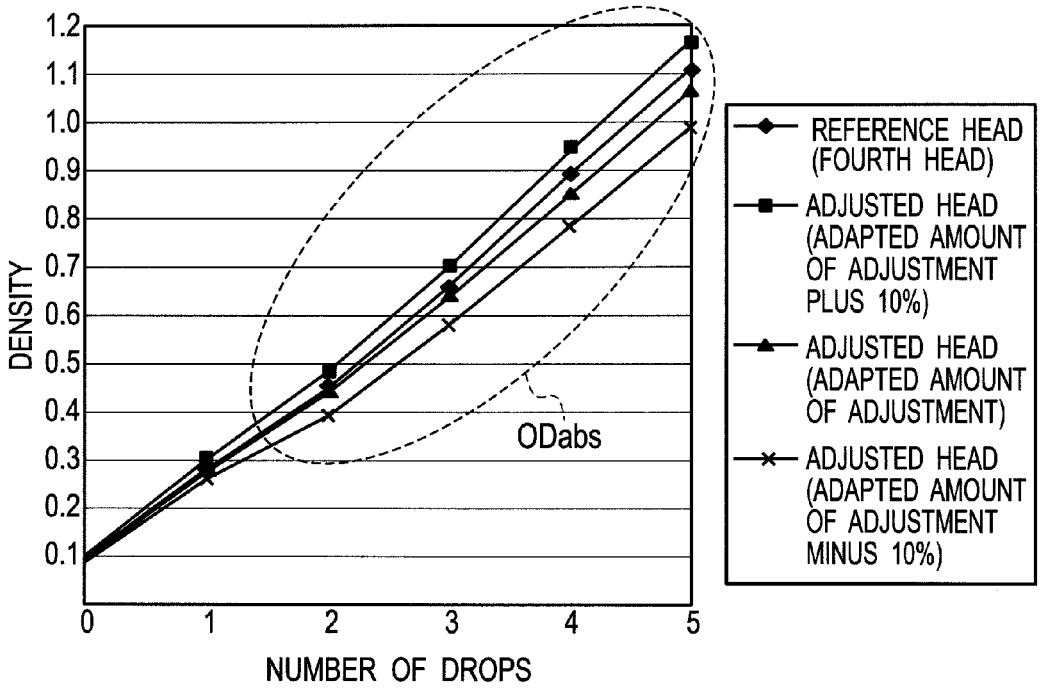

Because of the above, in the case of mat paper, even when the number of ink drops becomes four or five, the characteristics that the change in print density as the number of ink drops changes is linear are maintained as shown in FIG. 8B. Consequently, when the drive voltage of the ink head 110*a* adjusted for the ink head 110*a* (here, the fourth ink head), which is the reference of density adjustment, is changed by ±10%, respectively, a change in density substantially in proportion to the change in drive voltage occurs even when the number of ink drops is four or five.

However, in the case of mat paper, the dot gain is small as shown in FIG. 8B, and therefore, when the number of ink drops is small (=1), that is, when the dot area is small, it is not possible to fully expect the effect of a change in density because the change in dot area is small even if the drive voltage of the ink head 110*a* is adjusted.

Because of the above, in the present embodiment, the number of adjustment drops for mat paper to be stored in the storage section 334 is taken to be five, which is the maximum number of two to five with which a change in density occurs correspondingly by the adjustment of the drive voltage of the ink head 110*a* (the number of ink drops at the time of one-time discharge of ink=5).

It may also be possible to determine in advance the number of adjustment drops to be applied uniformly regardless of the kind of the print medium 10, for example, whether the print medium 10 is plain paper or mat paper, instead of determining the number of adjustment drops for each kind of the print medium 10 (print sheet) and storing the number in the storage section 334.

When determining the number of adjustment drops to be applied uniformly regardless of the kind of the print medium 10, it is necessary for the number of ink drops to be those with which the print density changes by not less than a fixed amount for the change in the number of ink drops in a predetermined range even if the dot gain of the print medium 10 is large so that a change in density occurs correspondingly by the adjustment of the drive voltage of the ink head 110*a*. At the same time, it is necessary for the number of ink drops to be those with which the dot area is not less than a certain area even if the dot gain of the print medium 10 is small.

It is conceivable that the print medium 10 having the largest dot gain is plain paper. Because of this, a range of the number of ink drops with which the print density changes by not less than a certain amount for the change in the number of ink drops is defined as a density change region (ODth) in plain paper. The density change region (ODth) is in the range where the number of ink drops is one to three as described above (see FIG. 8A). The density change region (ODth) is a region that specifies the reference value of the change in density in the present embodiment.

On the other hand, it is conceivable that the print medium 10 having the smallest dot gain is mat paper. Because of this, a range of the number of ink drops with which the dot area in mat paper is not less than a certain area (range of the number of ink drops with which the amount of change in print density in the image for the change in an ink drop amount is not less than a predetermined value) is defined as an absolute density region (ODabs). The absolute density region (ODabs) is a range where the number of ink drops is two to five as described above (see FIG. 8B). The absolute density region (ODabs) is a region that specifies the reference value of the absolute density in the present embodiment.

Because of the above, when uniformly applying the number of adjustment drops regardless of the kind of the print medium 10 (print sheet), it is sufficient to select the number of adjustment drops from among the numbers of ink drops present in the area where the above-described density change region (ODth) and absolute density region (ODabs) overlap.

By doing so, it is possible to enable suitable density adjustment of images corresponding to various kinds of print media from a print medium with a large dot gain to a print medium with a small dot gain.

Figure 10:
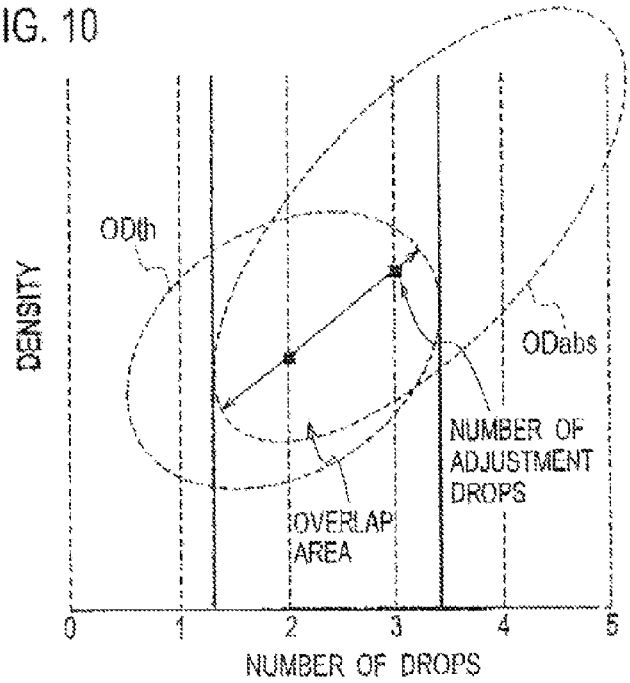
FIG. 10 is an explanatory diagram showing an outline of a procedure to determine the number of adjustment drops to be applied uniformly regardless of the kind of a print medium by an adjustment drop number setting section in FIG. 4.

Specifically, it is possible to set the maximum number of ink drops discharged from the ink head 110*a*, which is the target of density adjustment, as the number of adjustment drops (in the example in FIG. 10, the number of ink drops=3).

When there is a plurality of numbers of ink drops suitable to be set as the number of adjustment drops, it is possible to increase the width of density adjustment of images by adjusting the ink drop amount of one drop by setting the maximum number of ink drops as the number of adjustment drops.

As shown in FIG. 4, the adjustment drop number setting section 335 is a module to set the above-described number of adjustment drops. The number of adjustment drops is set as the optimum number of ink drops with which to make adjustment of the ink drop amount of one drop in units of the ink head 110*a*. In the present embodiment, there are a case where the adjustment drop number setting section 335 sets the number of adjustment drops in the storage section 334 corresponding to the kind of the print medium 10 a user has input through the list box 341*d* of the operation screen 341 (see FIG. 5) and a case where it sets the specified value as the number of adjustment drops common to the various kinds of the print medium 10 regardless of the kind of the print medium 10.

When setting the number of adjustment drops corresponding to the kind of the print medium 10, the adjustment drop number setting section 335 selects the corresponding number of adjustment drops from among those stored in the storage section 334 and sets it as the number of adjustment drops based on the input contents of the list box 341*d* of the operation screen 341 (see FIG. 5) and sets the ink head 110*a* for which the density adjustment is made based on the operation contents of the selection area 341*a* of the operation screen 341.

On the other hand, when setting the preset specified value as the number of adjustment drops, the adjustment drop number setting section 335 sets the ink head 110*a* for which the density adjustment is made based on the operation contents of the selection area 341*a* of the operation screen 341.

In the present embodiment, the print pattern of the density measurement chart is a chart in which the number of ink drops is changed and the print density is changed stepwise, but for example, it may also be possible to use a print pattern of a solid image by the number of adjustment drops set by the adjustment drop number setting section 335.

The number of adjustment drops set by the adjustment drop number setting section 335 is input to the drop amount determination section 336. The drop amount determination section 336 is a module to calculate an amount of change in the drop amount of each ink head 110*a* in the number of adjustment drops determined by the adjustment drop number setting section 335 according to the contents of density adjustment input by the operation of the slider 341*c* and determine the adjusted drop amount of the ink head 110*a*, which is the target of adjustment, specified by the operation of the selection area 341*a* of the operation screen 341.

Specifically, the drop amount determination section 336 performs an operation to appropriately adjust print density by increasing/decreasing the drop size of one ink drop discharged from the specified ink head 110*a* and extending/reducing the dot gain on the print medium 10 in the set number of adjustment drops. Then, as a result of the operation, the drop amount determination section 336 calculates the amount of change to be increased/decreased to obtain the appropriate drop amount as well as determining the drop amount necessary to achieve the appropriate print density. The drop amount determined by the drop amount determination section 336 is input to the drop amount adjustment section 337*a*.

The discharge control section 337 is a module to control discharge of the head unit 110 that discharges ink to the print medium 10. The head unit 110 forms a plurality of images on the print medium 10 according to the control by the discharge control section 337. Then, in the present embodiment, the discharge control section 337 includes a drop amount adjustment section 337*a*.

The drop amount adjustment section 337*a* is a module to adjust the drop amount of ink discharged by a plurality of the ink heads 110*a* and in the present embodiment, increases/decreases the drop amount (drop size) of each ink head 110*a* based on the drop amount determined by the drop amount determination section 336. In the present embodiment, the drop amount adjustment section 337*a* adjusts the drop amount for each ink head 110*a* by adjusting the drive voltage of the head.

(Density Adjustment Method)

Figure 11:
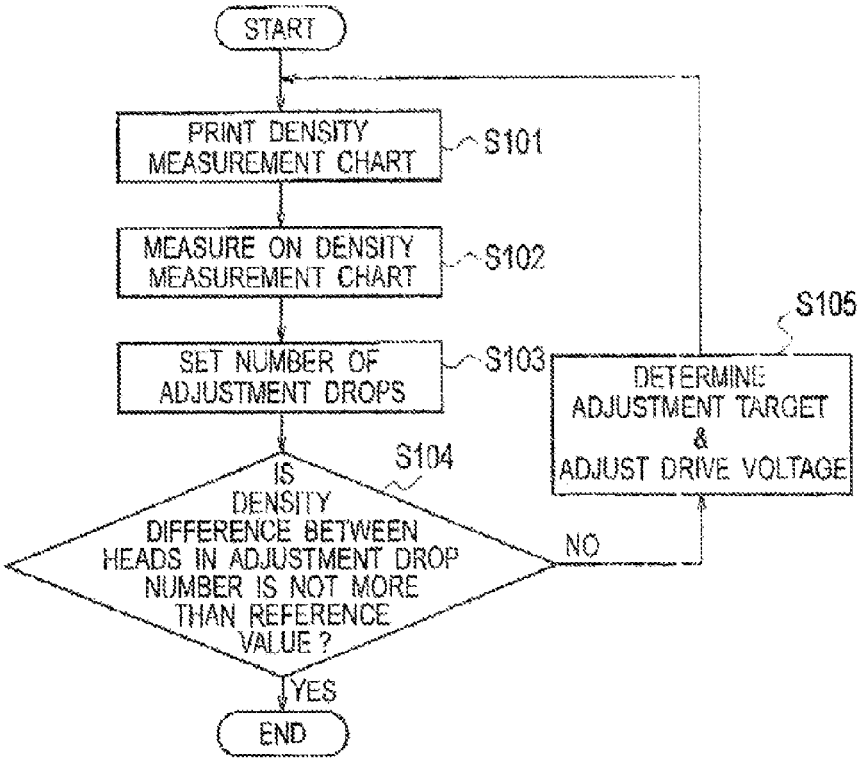
FIG. 11 is a flowchart showing an outline of a density adjustment method according to an embodiment of the present invention.

It is possible to perform the density adjustment method of the present invention by operating the density adjustment mechanism having the above configuration. FIG. 11 is a flowchart showing an outline of the density adjustment method according to the present embodiment.

First, when the density adjustment mode is started, for example, accompanying the user operation of the execution button 341*b* (see FIG. 5) of the operation screen 341 of the operation panel 340, the chart printing execution section 333*c* prints a density measurement chart (step S101). The printing of the density measurement chart may be performed based on the activation of the maintenance function performed periodically.

Then, the user visually measures the density difference in images between the two neighboring ink heads 110*a*, 110*a* on the printed density measurement chart (step S102). In particular, the user visually measures the presence/absence of a discontinuous density difference in which the print density drastically changes at the boundary part of the images by the two ink heads 110*a*, 110*a*.

Next, the number of adjustment drops is set (step S103). Here, when the user inputs the kind of the print medium 10 (print sheet) to be used through the list box 341*d* of the operation panel 340, the adjustment drop number setting section 335 sets the number of adjustment drops stored in the storage section 334 according to the kind. When the kind of the print medium 10 is not input, the adjustment drop number setting section 335 sets the number of adjustment drops to a predefined value that is applied uniformly regardless of the kind of the print medium 10.

Next, the user determines whether the density difference in images between the two neighboring ink heads 110*a*, 110*a* measured visually in step S102 is not more than the reference value (step S104) and when it is not more than the reference value (step S104: Y), the density adjustment mode is exited.

When the user determines that it exceeds the reference value (step S104: N), the ink head 110*a*, which is the target of density adjustment, is determined through the touch operation of the selection area 341*a* (see FIG. 5) of the operation panel 340 and the drop amount determination section 336 adjusts the drive voltage of the ink head 110*a* determined to be the target corresponding to the amount of change in the drop amount according to the contents of density adjustment input by the operation of the slider 341*c* of the operation panel 340 (step S105).

After that, by repeating the procedure from step S101 to S104 (also including the procedure of step S105 if necessary), the print density in the image by the ink head 110*a* is adjusted so that the user can determine by visual inspection that the density difference in images between the two neighboring ink heads 110*a*, 110*a* is not more than the reference value. After the adjustment is completed, the density adjustment mode is exited.

When discharging a plurality of ink drops to the same pixel, the total drop amount of the discharged ink is an integer multiple of the drop amount of one drop. Consequently, when contents of density adjustment are input by the operation of the slider 341*c* of the operation panel 340, the drop amount determination section 336 adjusts the drive voltage of the ink head 110*a* when discharging ink corresponding to one drop so that the total drop amount of ink is adjusted by an amount corresponding to the contents of adjustment.

Here, in general, the drive voltage of the ink head 110*a* when discharging one ink drop is the same regardless of the number of ink drops discharged to one pixel. Consequently, when the drop amount determination section 336 adjusts the drive voltage of the ink head 110*a* in the number of adjustment drops set by the adjustment drop number setting section 335, the drive voltage of the ink head 110*a* when discharging one ink drop in the case where ink is discharged to one pixel in another number of ink drops is also adjusted in an interlocking manner as a result.

(Working/Effect)

According to the present embodiment, the number of adjustment drops with which a remarkable change in density in the image occurs when the ink drop amount of one drop is changed is set for each kind of the print medium 10 (print sheet) or it is set uniformly regardless of the kind of the print medium 10 and when adjustment of print density is necessary, the drop amount is adjusted by adjusting the drive voltage of the ink head 110*a* in the number of adjustment drops.

In the density measurement chart (see FIG. 6) printed by the chart printing execution section 333*c*, an image by the ink drops in the number of adjustment drops discharged by each ink head is formed so that it can be distinguished for each discharged ink of each ink head. Because of this, it is possible to easily determine how much density difference exists between each ink head in the images printed by the ink drops in the number of adjustment drops and to easily determine how much the drop amount of one ink drop in the number of adjustment drops should be adjusted.

Because of the above, it is possible to efficiently and appropriately adjust density to reduce a density difference in images between the ink heads 110*a* when a density difference that exceeds the reference value is recognized visually between images by the two neighboring ink heads 110*a*, 110*a* on the density measurement chart.

That is, according to the present embodiment, in a line inkjet recording apparatus in which ink heads of multi-drop type are directly-aligned, it is possible to set the number of ink drops according to the situation of the occurrence of a density difference as the number of adjustment drops and to make adjustment of the ink drop amount with the optimum number of ink drops, and therefore, it is possible to efficiently and appropriately make density adjustment to reduce the density difference between heads.

Further, when the ink drop amount of one drop is adjusted in the number of adjustment drops, the ink drop amount of one drop in a number of ink drops other than the number of adjustment drops is also adjusted as a result. Consequently, while it is only possible to adjust the amount of ink to be discharged by, for example, three levels, that is, a large amount, medium amount, and small amount in the inkjet recording apparatus in the bend mode, it is possible to adjust the ink drop amount of one drop also in a number of ink drops other than the number of adjustment drops according to the contents of adjustment made as to the number of adjustment drops with which the print density in an image changes efficiently. Because of this, it is possible to efficiently make appropriate density adjustment of images.

Further, according to the present embodiment, the adjustment of the ink drop amount is made by the adjustment of the drive voltage of the ink head 110*a*, and therefore, it is possible to securely reflect the contents of adjustment in the ink drop amount by the adjustment of the drive voltage of the ink head 110*a* that directly affects the ink drop amount.

Furthermore, according to the present embodiment, the number of adjustment drops for a print medium having a small ink gain, such as mat paper, is set to the number of ink drops with which the density value of the image is in the absolute density reference region (the region ODabs in FIG. 8B).

In this case, the ink drop amount of one drop is adjusted in the number of ink drops (number of adjustment drops) with which an image of a somewhat higher density is formed. Consequently, it is made possible to secure a corresponding change between print densities of images formed by discharged ink in the number of adjustment drops before and after adjustment of drop amount.

Because of this, it is possible to set the number of adjustment drops with which appropriate density adjustment of images can be made by efficiently changing the print density in the image by the adjustment of the ink drop amount of one drop to an appropriate number of ink drops from the standpoint of the density value of images. In particular, when using a print medium having a small dot gain, into which ink is hard to permeate and in which the area of ink discharged to a pixel according to the number of ink drops changes remarkably, it is possible to make appropriate density adjustment of images by efficiently changing the print density in the image by adjusting the ink drop amount of one drop.

Further, according to the present embodiment, the number of adjustment drops for a print medium having a large dot gain, such as plain paper, is set to the number of ink drops with which the amount of change in print density in the image for the change in the number of ink drops is in the density change region (the region ODth in FIG. 8A).

In this case, the ink drop amount of one drop is adjusted in the number of ink drops (number of adjustment drops) with which the change in density in the image by the change in the number of ink drops is remarkable. Consequently, it becomes easy to distinguish between the change in density in the image by adjustment of the drop amount and the change in density in the image by the change in the number of ink drops.

Because of this, it is possible to set the number of adjustment drops with which appropriate density adjustment of images can be made by efficiently changing the print density in the image by the adjustment of the ink drop amount of one drop to the number of ink drops appropriate from the standpoint of the amount of change in density in the image by the adjustment of the ink drop amount of one drop. In particular, when using a print medium having a large dot gain, into which ink permeates easily and in which the change in area (change in density) of ink discharged to a pixel becomes more likely to saturate with the increasing number of ink drops, it is possible to make the appropriate density adjustment of images by efficiently changing the print density in the image by the adjustment of the ink drop amount of one drop.

Further, by making the adjustment of the ink drop amount by the adjustment of the drive voltage of the ink head 110*a*, it is possible to easily change the print density in an image with each number of ink drops by interlockingly changing the amount of ink to be discharged in the same manner as that when discharging ink in the number of adjustment drops also at the time of discharge of ink in a number of ink drops other than the number of adjustment drops.

It may also be possible to determine whether or not density adjustment is necessary, to specify the ink head 110*a* that requires density adjustment, and to determine the amount of density adjustment without using the density measurement chart explained in each embodiment described above. For example, it may also be possible to specify and determine based on the printed matter obtained by the normal printing operation.

Further, it may also be possible to specify the ink head 110*a*, which is the target of density adjustment, and to input the amount of density adjustment of an image by a method other than the operation of the operation panel 340 in the density adjustment mode explained in each embodiment described above. For example, it may also be possible to specify the ink head 110*a*, which is the target of density adjustment, and to input the amount of density adjustment of an image without entering a specific mode by connecting an external operation terminal (not shown schematically) and inputting through this operation terminal at the time of maintenance.

The present application claims the benefit of priority under 35 U.S.C. §119 to Japanese Patent Application No. 2010-266600, filed on Nov. 30, 2010, the entire content of which is incorporated herein by reference.

What is claimed is:

1. An inkjet recording apparatus including at least one head unit having a plurality of ink heads and forming an image on a print medium by discharging a plurality of ink drops from each ink head, comprising:

an ink head specifier configured to specify an ink head, which is a target of adjustment of print density in the image, in a density adjustment mode of adjusting the print density in the image at a time which is different from the time of forming the image on the print medium;

an adjustment contents specifier configured to specify a number of adjustment drops with which an amount of change in the print density in the image for a change in ink drop amount of one ink drop is not less than a predetermined value as to the ink head specified by the ink head specifier in the density adjustment mode, and the adjustment contents specifier further configured to specify contents of adjustment of an ink drop amount with which a change in the print density occurs correspondingly by the adjustment of the ink drop amount of one ink drop in the number of adjustment drops of the ink head; and a drop amount adjuster configured to adjust the ink drop amount of one ink drop in the number of adjustment drops of the ink head specified by the ink head specifier with the contents of adjustment specified by the adjustment contents specifier.

2. The inkjet recording apparatus according to claim 1, further comprising:

a print medium specifier configured to specify a kind of the print medium in the density adjustment mode; and an adjustment drop number selector configured to select a number of adjustment drops corresponding to the print medium of the kind specified by the print medium specifier in the density adjustment mode, wherein the drop amount adjuster adjusts the ink drop amount of one ink drop in the number of adjustment drops selected by the adjustment drop number selector of the ink head specified by the ink head specifier with the contents of adjustment specified by the adjustment contents specifier.

3. The inkjet recording apparatus according to claim 1, wherein the drop amount adjuster adjusts the ink drop amount of one drop in the number of adjustment drops of the ink head specified by the ink head specifier by adjusting a drive voltage of the ink head with the contents of adjustment specified by the adjustment contents specifier.

4. The inkjet recording apparatus according to claim 1, wherein the number of adjustment drops is set to a number of drops within a range of a number of ink drops with which an amount of change in print density in the image for a change in ink drop amount is not less than a predetermined value for a print medium of a kind with the largest dot gain of the kinds of print media that can be set.

5. The inkjet recording apparatus according to claim 1, wherein the number of adjustment drops is set to a number of drops within a range of a number of ink drops with which an amount of change in print density in the image for a change in ink drop amount is not less than a predetermined value for a print medium of a kind with the smallest dot gain of the kinds of the print media that can be set.

6. The inkjet recording apparatus according to claim 1, wherein the number of adjustment drops is set to one of numbers of drops within an overlap area of a range of a number of ink drops with which an amount of change in print density in the image for a change in ink drop amount is not less than a predetermined value for a print medium of a kind with the largest dot gain of the kinds of print media that can be set and a range of a number of ink drops with which an amount of change in print density in the image for a change in ink drop amount is not less than a predetermined value for a print medium of a kind with the smallest dot gain of the kinds of the print media that can be set.

7. The inkjet recording apparatus according to claim 6, wherein the number of adjustment drops is set to the maximum number of drops of the numbers of drops within the overlap area.

8. A method for adjusting print density in an image in an inkjet recording apparatus provided with at least one head unit having a plurality of ink heads and forming the image on a print medium by discharging a plurality of ink drops from each ink head, the method comprising:

specifying the ink head, which is a target of adjustment of print density in the image, in a density adjustment mode of adjusting print density in the image at a time which is different from the time of forming the image on the print medium;

specifying a number of adjustment drops with which an amount of change in print density in the image for a change in ink drop amount of one ink drop is not less than a predetermined value as to the specified ink head in the density adjustment mode;

specifying contents of adjustment of an ink drop amount with which a change in the print density occurs correspondingly by the adjustment of the ink drop amount of one ink drop in the number of adjustment drops of the ink head; and adjusting an ink drop amount of one ink drop in the number of adjustment drops of the specified ink head with the specified contents of adjustment.

* * * * *